US005653391A

United States Patent [19]

Inamura et al.

[11] Patent Number: 5,653,391

[45] Date of Patent: Aug. 5, 1997

[54] FIRE EXTINGUISHING HEAD

[75] Inventors: Katsumasa Inamura; Seiji Chiba, both of Tokyo, Japan

[73] Assignee: Nohmi Bosai Ltd., Tokyo, Japan

[21] Appl. No.: 384,656

[22] Filed: Feb. 6, 1995

[30] Foreign Application Priority Data

Feb. 15, 1994 [JP] Japan ..... 6-018689
Feb. 15, 1994 [JP] Japan ..... 6-018690

[51] Int. Cl.[6] ..... B05B 1/26

[52] U.S. Cl. ..... 239/543; 239/472; 239/560; 239/561

[58] Field of Search ..... 239/436, 439, 239/472, 493, 497, 556, 560, 561, 565, 543

[56] References Cited

U.S. PATENT DOCUMENTS

| | | | |
|---|---|---|---|
| 1,335,267 | 3/1920 | Ambrose et al. . | |
| 1,650,136 | 11/1927 | Koberle | 239/565 X |
| 2,235,258 | 3/1941 | Jones | 239/556 X |
| 2,254,751 | 9/1941 | Paradise . | |
| 2,569,081 | 9/1951 | Veach | 239/472 |
| 2,647,800 | 8/1953 | Burnam et al. | 239/556 X |
| 2,746,792 | 5/1956 | Hough . | |
| 3,716,192 | 2/1973 | Hunter . | |
| 3,844,485 | 10/1974 | Waggoner | 239/543 X |
| 4,944,460 | 7/1990 | Steingass | 239/439 X |
| 5,125,579 | 6/1992 | Eggert | 239/439 |

FOREIGN PATENT DOCUMENTS

| | | | |
|---|---|---|---|
| 453941 | 1/1949 | Canada | 239/543 |
| 546332 | 9/1957 | Canada | 239/561 |
| 1195735 | 11/1959 | France . | |
| 1013916 | 8/1957 | Germany . | |

*Primary Examiner*—Andres Kashnikow
*Assistant Examiner*—Steven J. Ganey
*Attorney, Agent, or Firm*—Wenderoth, Lind & Ponack

[57] ABSTRACT

A fire extinguishing head includes a pair of medium range nozzles having a shooting distance shorter than that of a long range nozzle and disposed on opposite sides of the long range nozzle in such a manner as to sandwich the long range nozzle. A short range nozzle having a shooting distance shorter than that of the medium range nozzle is disposed below the long range nozzle.

21 Claims, 20 Drawing Sheets

FIRE EXTINGUISHING HEAD

BACKGROUND OF THE INVENTION

1. Field of the Invention

The present invention relates to a fire extinguishing head for use in large exhibition halls, atriums, gymnasiums or the like. More particularly, the present invention relates to a fire extinguishing head capable of sprinkling water evenly on a large rectangular fire area, for example, a fire area of 5 m wide×20 m long.

2. Description of the Related Art

Hitherto, to evenly sprinkle water on a wide rectangular fire area, a fire extinguishing head comprising a plurality of nozzles which have different shooting ranges from each other and are arranged in the upper and lower portions thereof has been used. The nozzles are disposed in the fire extinguishing head in sequence from the top: a long range nozzle, a medium range nozzle having a range shorter than that of the long range nozzle, and a short range nozzle having a range shorter than that of the medium range nozzle.

The conventional fire extinguishing head, however, has the problems described below.

1) Discharge water flow discharged from the short range nozzle draws air together with discharge water flow discharged from the medium range nozzle, and discharge water flow discharged from the medium range nozzle draws air together with discharge water flow discharged from the long range nozzle. For this reason, the shooting range of each nozzle decreases less than a designed value, and therefore it is not possible to sprinkle water evenly all over a wide rectangular sprinkling area of a length as great as 20 m;
2) Since the sprinkling area of each nozzle is predetermined, for example, the long distance area for the long range nozzle, or the medium distance area for the medium range nozzle, the particle diameter of discharge water differs in different areas.
3) Since the sprinkling area of each nozzle is predetermined, it is difficult to evenly sprinkle water in a neat rectangular discharge water pattern.

SUMMARY OF THE INVENTION

The present invention has been achieved to solve the above-described problems of the prior art. An object of the present invention is to provide a fire extinguishing head capable of evenly sprinkling water on a large rectangular sprinkling area.

To achieve the above object, a fire extinguishing head in accordance with the present invention comprises a first nozzle means; and a second nozzle means having a shooting distance shorter than that of the first nozzle means, a discharge water flow from the first nozzle means colliding with at least a part of a discharge water flow from the second nozzle means in the middle of the fall thereof.

DESCRIPTION OF THE PREFERRED EMBODIMENTS

Preferred embodiments of the present invention will be explained below with reference to the accompanying drawings.

Figure 1:
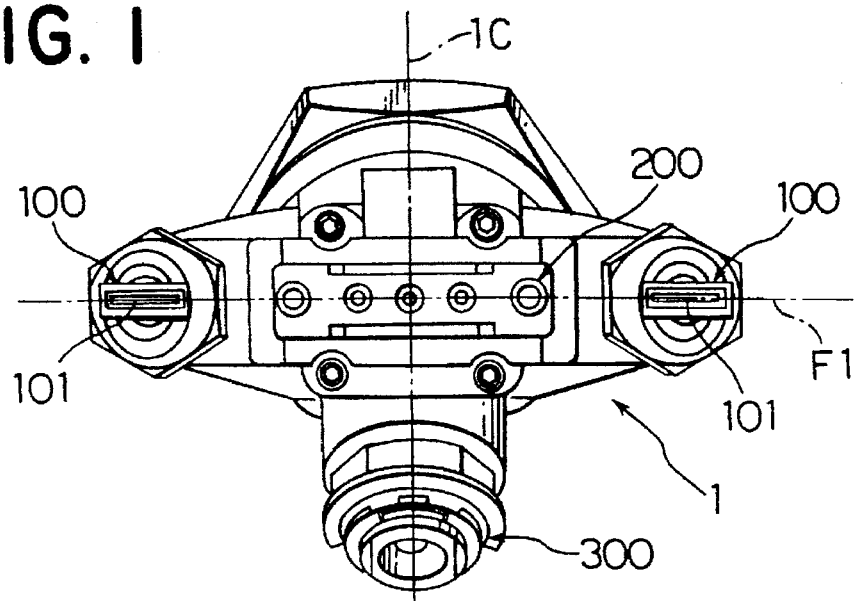
FIGS. 1 to 3 are a front view, a side view and a partially cutaway plan view illustrating a fire extinguishing head in accordance with a first embodiment of the present invention, respectively.
Figure 2:
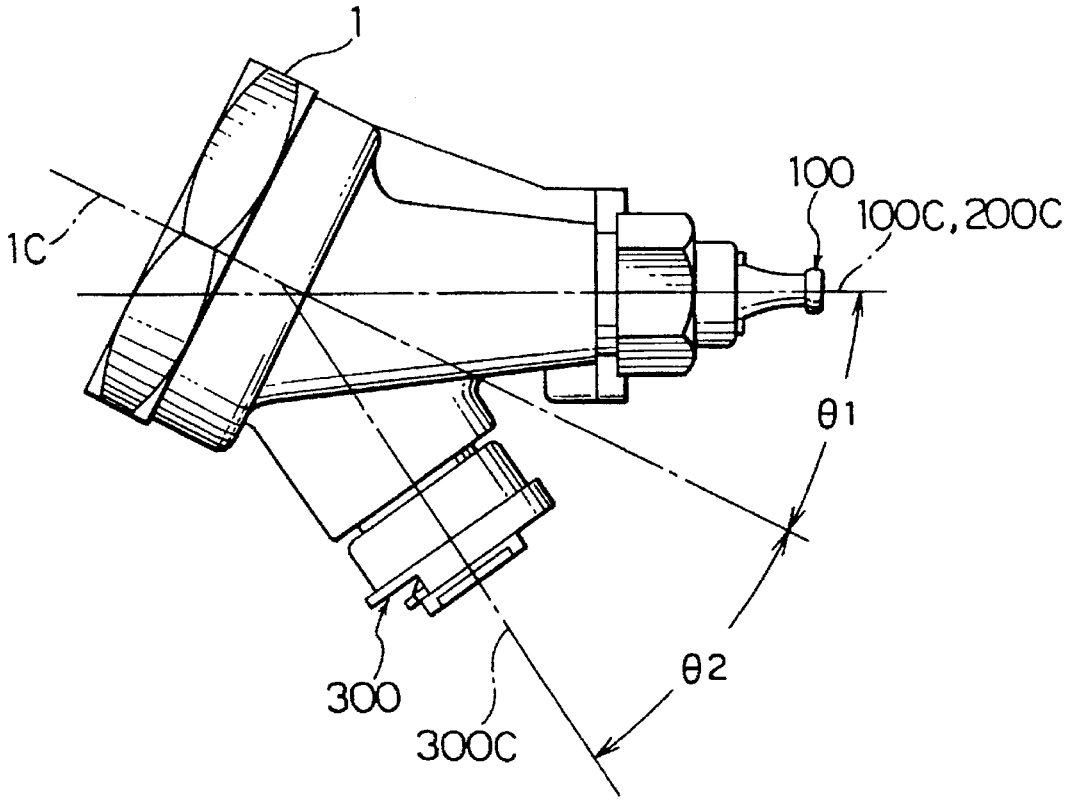
Figure 3:
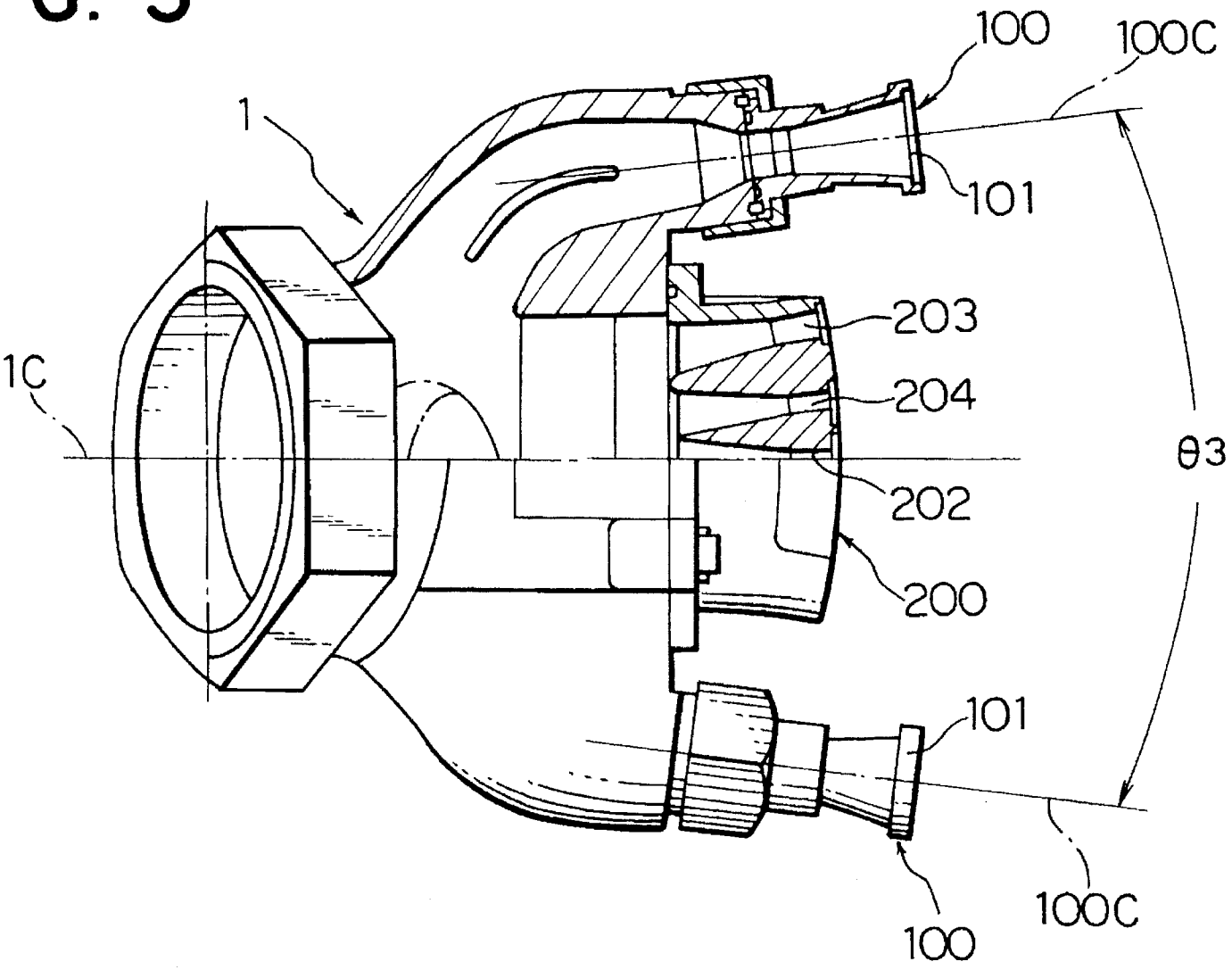

First Embodiment:

Referring to FIGS. 1 to 3, a fire extinguishing head 1 in accordance with a first embodiment of the present invention comprises a long range nozzle 200, a pair of medium range nozzles 100 disposed on both sides of the long range nozzle 200, and a short range nozzle 300 disposed below the long range nozzle 200.

The center axes 100C of the medium range nozzles 100 and the center axis 200C of the long range nozzle 200 are on the same plane. As shown in FIG. 2, the center axis 200C of the long range nozzle 200 is inclined by an angle θ 1 relative to the center axis 1C of the fire extinguishing head 1. The angle θ 1 is appropriately selected by taking the sprinkling area into consideration, for example, an angle θ 1=26° is selected.

The center axis 300C of the short range nozzle 300 is inclined by an angle θ 2 relative to the center axis 1C of the fire extinguishing head 1. The angle θ 2 is appropriately selected by taking the sprinkling area into consideration, for example, an angle θ 2=30° is selected.

Figures 21A, 21B, 21C:
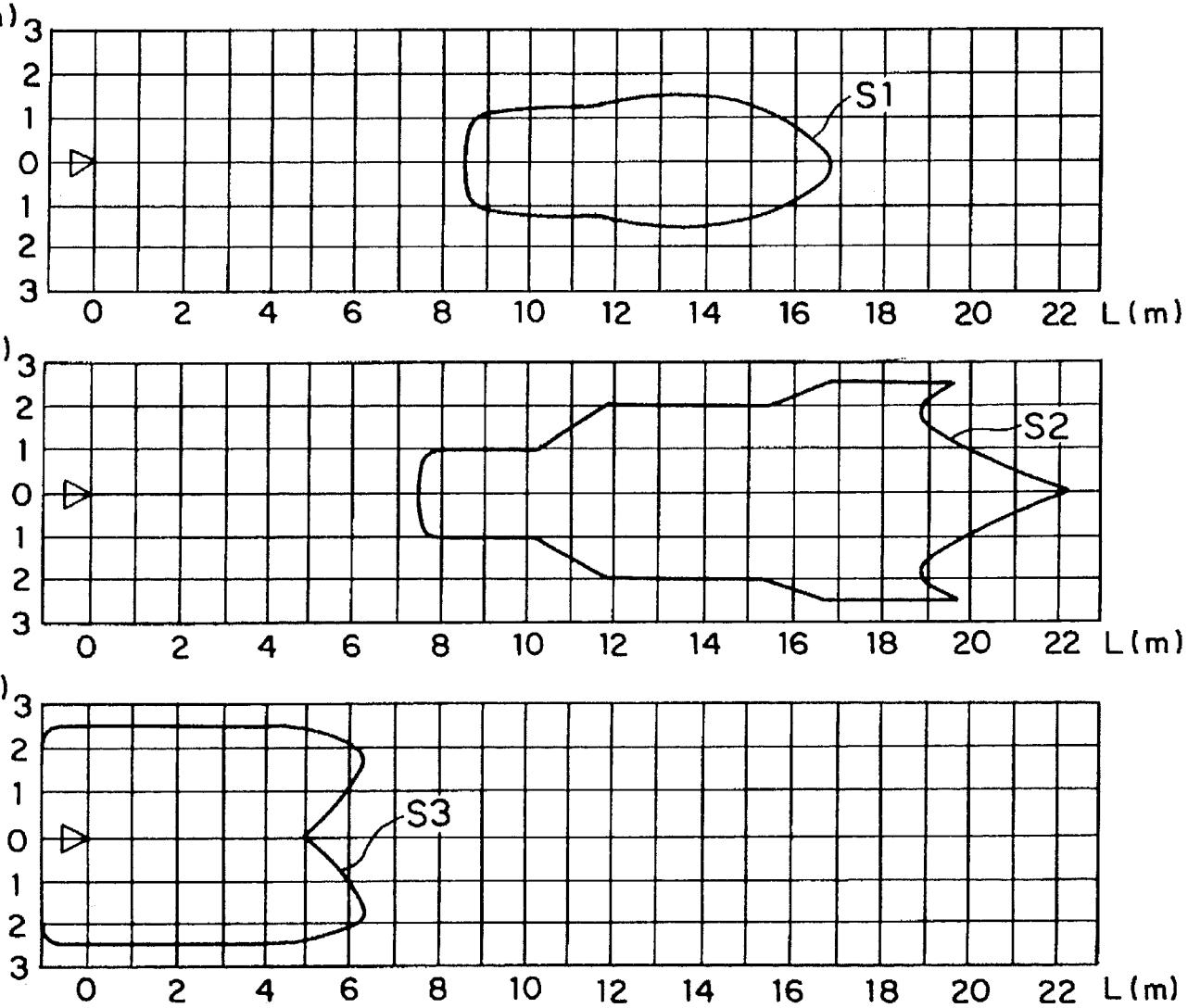
FIG. 21A is a graph showing a sprinkling area when the medium range nozzle is used by itself.
FIG. 21B is a graph showing a sprinkling area when the long range nozzle is used by itself.
FIG. 21C is a graph showing a sprinkling area when the short range nozzle is used by itself.

Each of the medium range nozzles 100 is a fan-shaped nozzle having a shooting distance shorter than that of the long range nozzle 200 and longer than that of the short range nozzle 300. When the medium range nozzle 100 is used by itself, the shooting distance L is approximately 8.5 to 16 m, and the sprinkling width W is approximately 2 to 3 m, and a sprinkling area S1 shown in FIG. 21A is formed.

Figure 5:
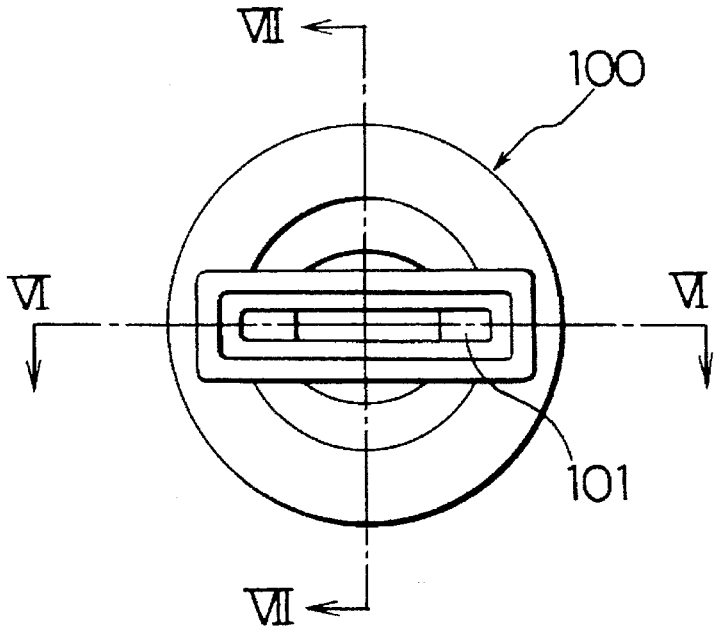
FIG. 5 is a front view of a medium range nozzle used in the first embodiment.
Figure 6:
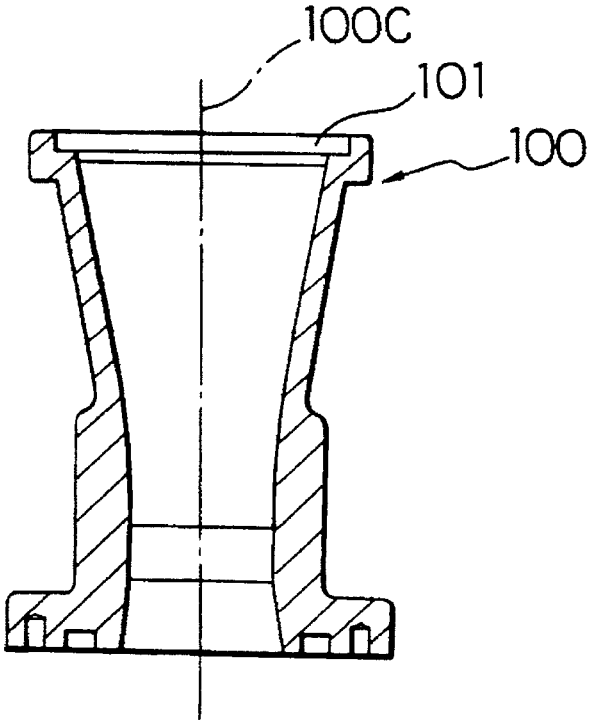
FIG. 6 is a sectional view taken along the line VI—VI of FIG. 5.
Figure 7:
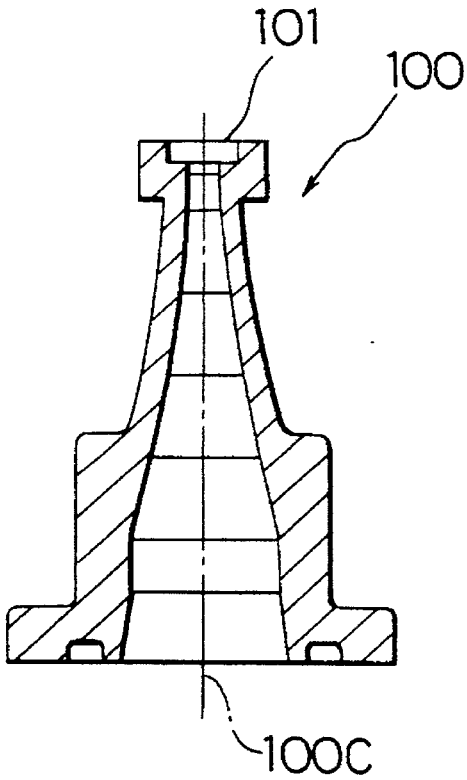
FIG. 7 is a sectional view taken along the line VII—VII of FIG. 5.

The pair of medium range nozzles 100 are disposed so as to sandwich the long range nozzle 200 on the same horizontal line F1. As shown in FIG. 3, the intersection angle θ 3 of the center axes 100C of the medium range nozzles 100 is appropriately selected by taking the sprinkling area into consideration, for example, an angle θ 3=14° is selected. As shown in FIGS. 5 to 7, the medium range nozzle 100 increases in diameter toward an exit 101 which is formed in a rectangular shape.

The long range nozzle 200 has a shooting distance longer than those of the medium range nozzles 100 and the short range nozzle 300, and therefore is a jet nozzle having the longest shooting distance among the nozzles. When the long range nozzle 200 is used by itself, the shooting distance L thereof is approximately 7 to 22 m, and the sprinkling width W thereof is approximately 2 to 5 m, and a sprinkling area S2 shown in FIG. 21B is formed.

Figure 8:
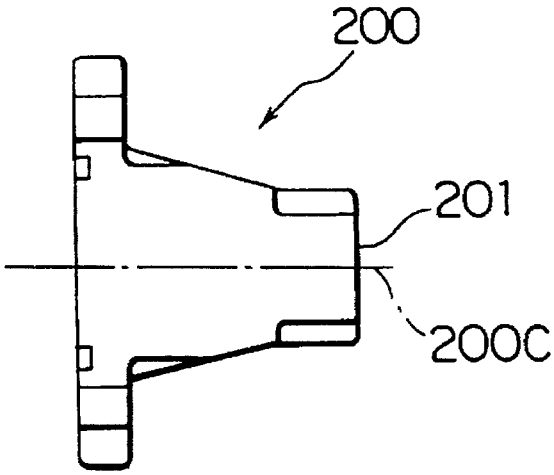
FIGS. 8 to 10 are a side view, a plan view and a front view of a long range nozzle used in the first embodiment, respectively.
Figure 9:
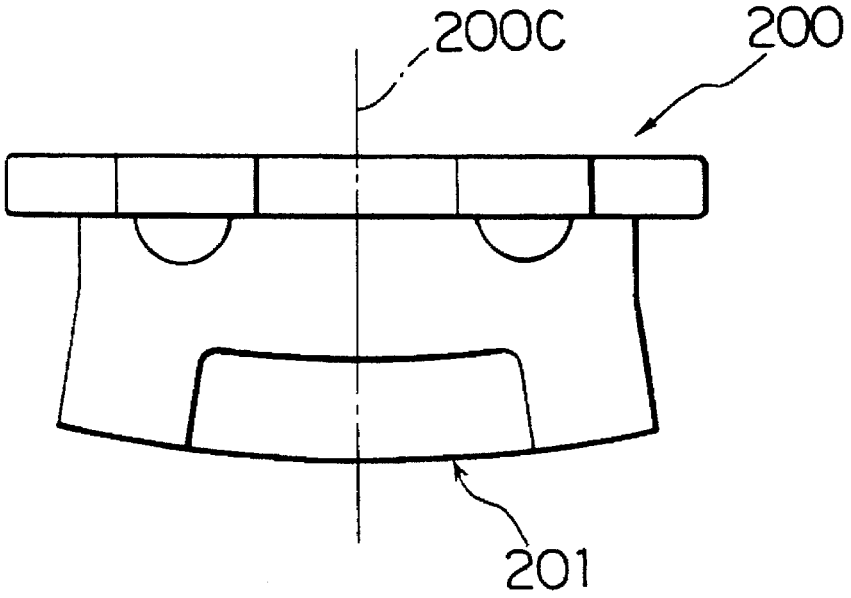
Figure 10:
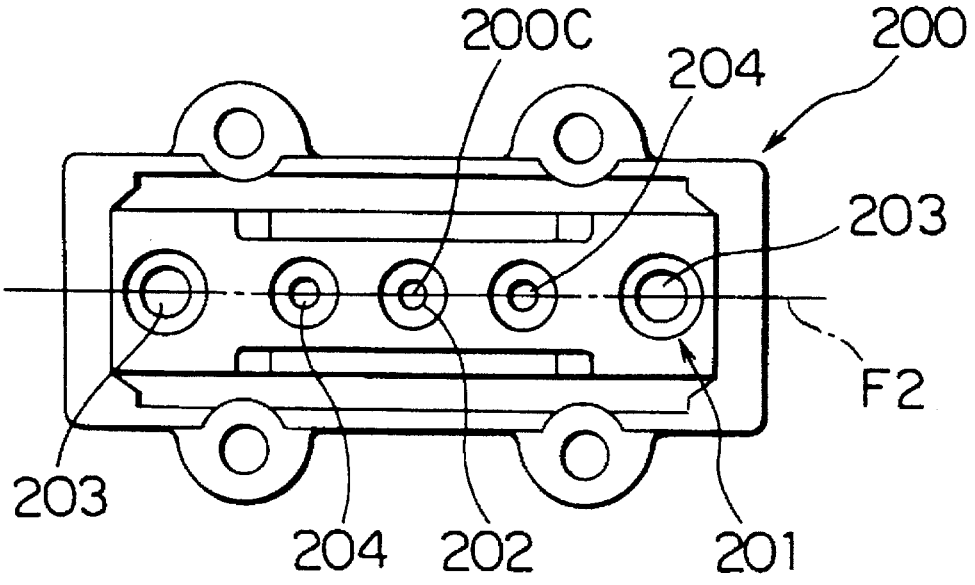

As shown in FIGS. 8 to 10, the long range nozzle 200 has a group of discharge outlets 201 disposed so as to be spaced from each other on the same horizontal line F2. The group of discharge outlets 201 are formed with a medium-diameter hole 202 in the central portion thereof, large-diameter holes 203 disposed on both sides of the medium-diameter hole 202, and small-diameter holes 204 disposed between the medium-diameter hole 202 and the large-diameter holes 203. The center axis 200C of the medium-diameter hole 202 intersects with the center axis 1C of the fire extinguishing head 1.

The diameters of the holes 202 to 204 differ from each other. This is because of the following reasons 1) to 3):

1) Since the water flow from a nozzle hole is more susceptible to be influenced by air resistance, it is necessary for the outer nozzle hole to have a large flow rate in order not to be influenced thereby.
2) When the water flow in the center is largely increased, sprinkling of water converges in the center. To prevent the sprinkling of water from converging in the center, water of a medium flow rate should be discharged from the nozzle hole in the center.
3) It is necessary to make the water flows from the nozzle holes between the center nozzle hole and the outer nozzle holes on both side ends follow the sprinkling of water from the center hole and the outer holes in order to evenly sprinkle water.

By taking the above-described circumstances into consideration, the holes 202 to 204 are formed in such a way that the diameter ratio of the large-diameter hole 203, the small-diameter holes 204 and the medium-diameter hole 202 becomes, for example, 7:4:5. Of course, this ratio may be, changed appropriately as required.

The long range nozzle 200 functions to compensate for the omission of the sprinkling area of the discharge water flow jetted from the medium range nozzles 100.

The short range nozzle 300 has a shooting distance shorter than those of the medium range nozzles 100 and the long range nozzle 200, and therefore has the shortest shooting distance among the nozzles. When the short range nozzle 300 is used by itself, the shooting distance L is from approximately 1 m in the back to approximately 6 m toward the front, and the sprinkling width W is approximately 4 to 5 m, and the sprinkling area S3 shown in FIG. 21C is formed.

Figure 11:
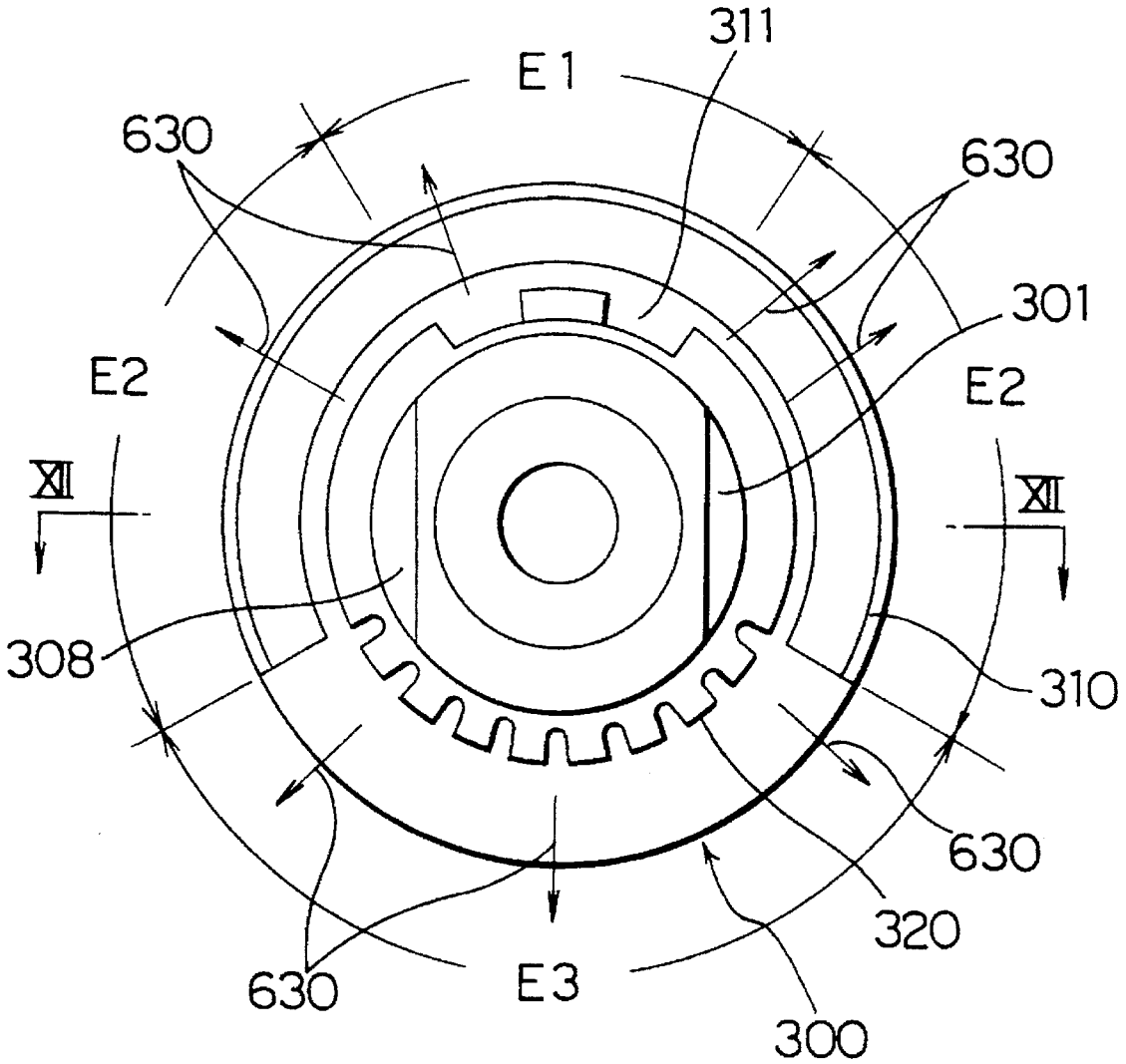
FIG. 11 is a front view of a short range nozzle used in the first embodiment.
Figure 12:
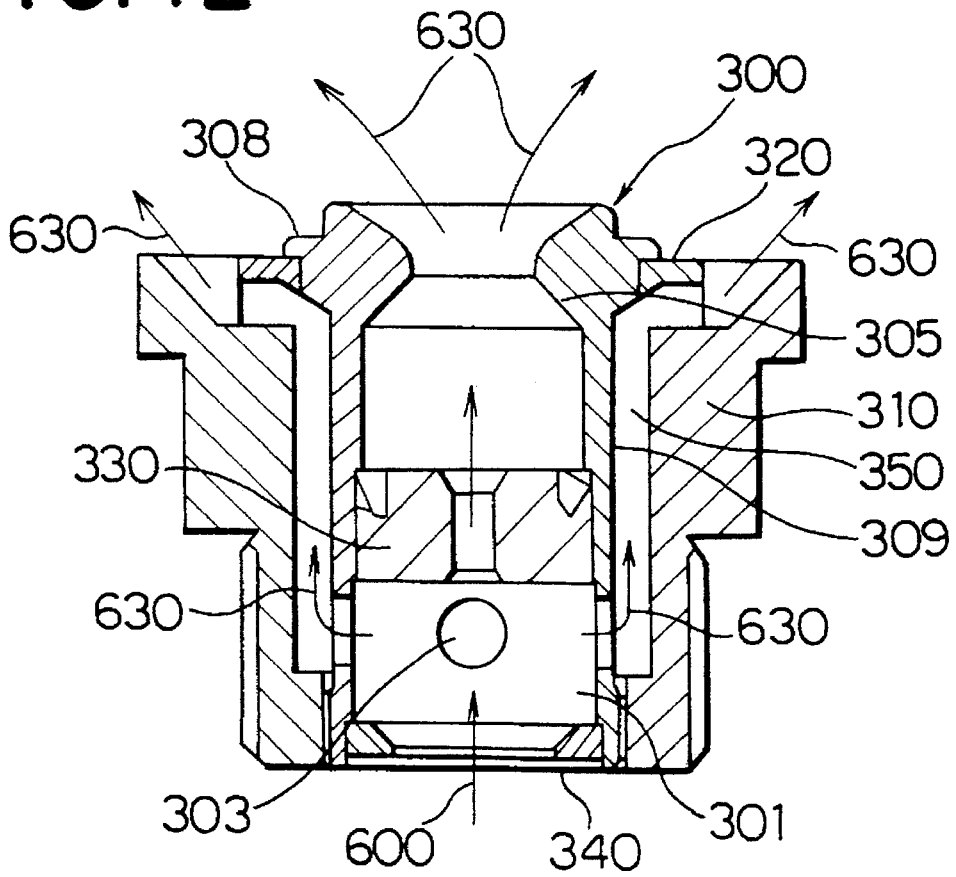
FIG. 12 is a sectional view taken along the line XII—XII of FIG. 11.

As shown in FIGS. 11 and 12, the short range nozzle 300 comprises an inner nozzle 301, an outer nozzle 310 engaged with the inner nozzle 301, and a deflector 320 disposed between the inner nozzle 301 and the outer nozzle 310.

Figure 13:
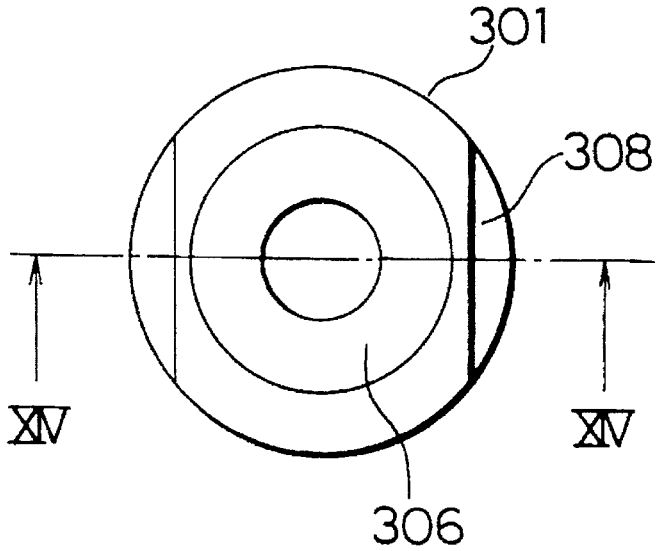
FIG. 13 is a front view of an inner nozzle of the short range nozzle.
Figure 14:
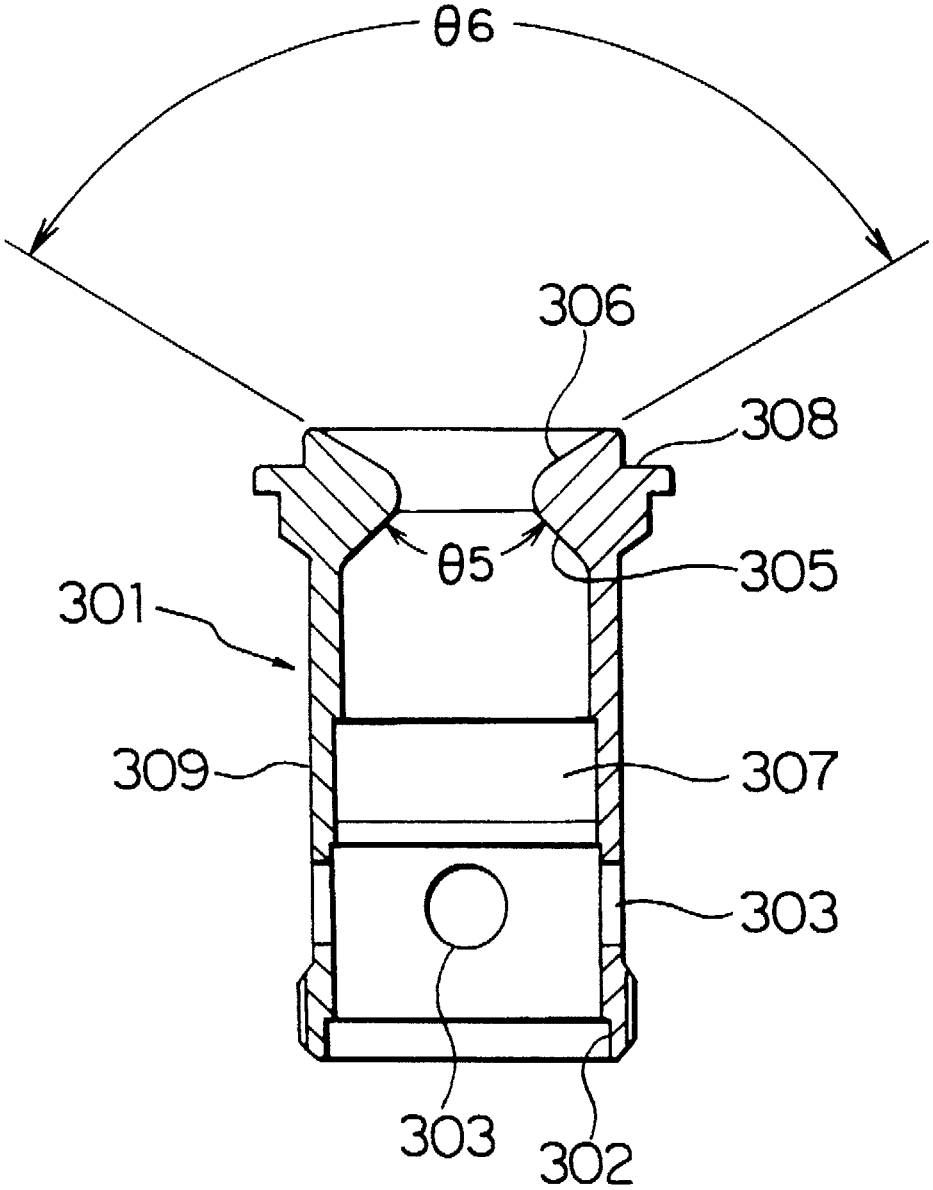
FIG. 14 is a sectional view taken along the line XIV—XIV of FIG. 13.
Figure 15:
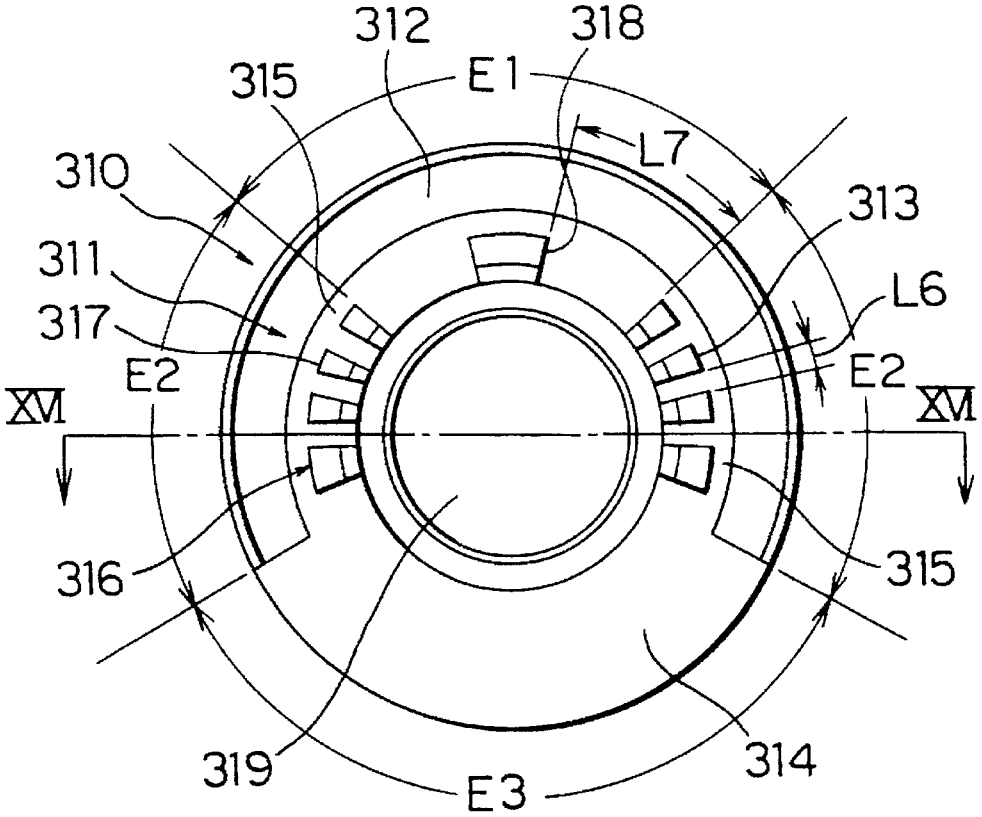
FIG. 15 is a front view of an outer nozzle of the short range nozzle.

As shown in FIGS. 13 and 14, an orifice housing section 302 is disposed in the back end portion of the inner nozzle 301, and a plurality of water supply holes 303 which are connected to a discharge outlet 311 of the outer nozzle 310 as shown in FIGS. 11 and 15, are disposed in a body 309 of the inner nozzle 301.

A reducing section 305 is disposed in the tip of the inner nozzle 301. The angle θ 5 of the reducing section 305 is determined appropriately as required, for example, the angle θ 5=90°. Reference numeral 308 denotes an engagement stepped portion for a tool or the like.

A discharge outlet 306 of the inner nozzle 301 is formed in a radial form, and a radial angle θ 6 thereof is determined appropriately as required, for example, the angle θ 6=120°. A spiral housing section 307 is formed between the reducing section 305 and the water supply holes 303.

Figure 16:
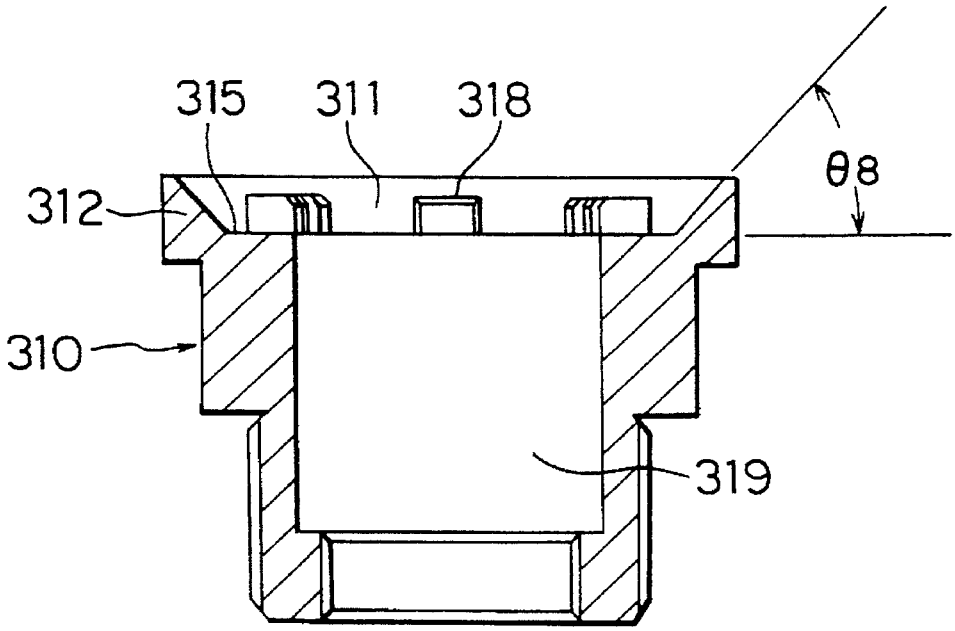
FIG. 16 is a sectional view taken along the line XVI—XVI of FIG. 15.

As shown in FIGS. 15 and 16, a guide ring 312 and a resistance ring 313 are formed concentrically, and an annular passage 315 is formed between the rings 312 and 313. The inner surface of the guide ring 312 is inclined toward the outside. An inclination angle θ 8 of the guide ring 312 is appropriately determined as required, for example, the inclination angle θ 8=45°.

A cutout portion 314 is disposed in the front half portion of the guide ring 312, and water sprinkling from the cutout portion 314 forms a lower water discharge area E3. A water discharge angle of the lower water discharge area E3 is appropriately determined as required, for example, 125°.

The resistance ring 313 is formed of a plurality of fan-shaped projection pieces 316 disposed so as to be spaced circumferentially. The resistance ring 313 is disposed concentrically within the guide ring 312. There are no projection pieces in the portion corresponding to the lower water discharge area E3. A plurality of side projection pieces 317 are disposed at intervals L6 in the portion corresponding to a side water discharge area E2, and a central projection piece 318 is disposed in the central portion corresponding to an upper water discharge area E1.

The central projection piece 318 is formed larger than each of the side projection pieces 317, and an interval L7 between the central projection piece 318 and the adjacent side projection piece 317 is formed larger than the interval L6. Water discharge area angles of the side water discharge area E2 and the upper water discharge area E1 are appropriately determined as required, for example, the angle of the area E2=45° and the angle of the area E1=90°. Reference numeral 319 denotes a passage in which the inner nozzle 301 is inserted.

Figure 17:
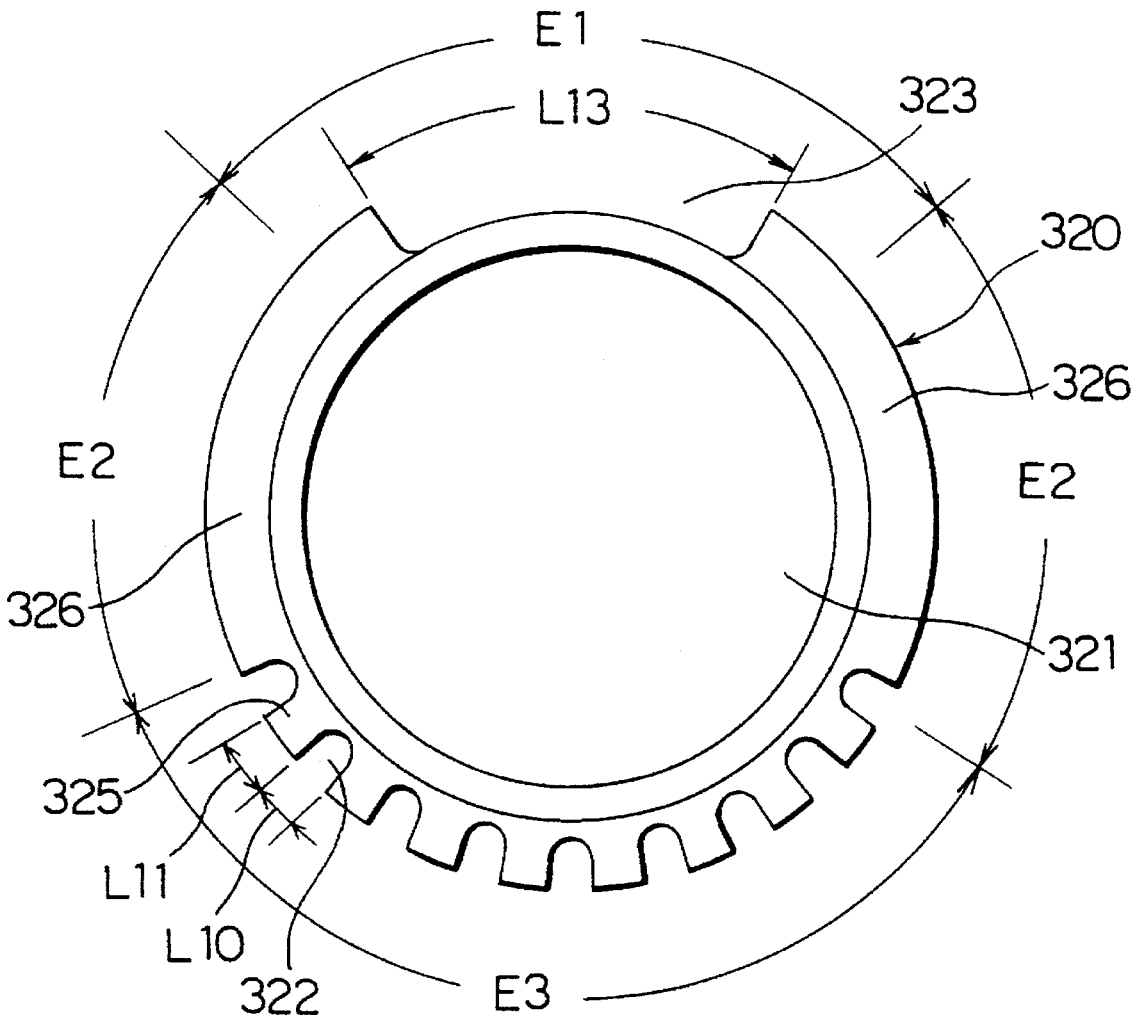
FIG. 17 is a front view of a deflector of the short range nozzle.

As shown in FIG. 17, an engagement port 321 of the inner nozzle 301 is formed in the central portion of a deflector 320, and cutout portions 322 and 323 are formed in the circumferential edge thereof. Each of the cutout portions 322 is a lower cutout portion and forms a U-shaped groove having a width L10 which is substantially the same as the width L11 of dispersed projections or pieces 325 defining portions 322. The plurality of cutout portions 322 are formed evenly over the entire sprinkling area corresponding to the lower water discharge area E3. The shape and the number of the cutout portions 322 are appropriately determined as required.

The cutout portion 323 is an upper cutout portion and formed in the portion corresponding to the upper water discharge area E1. A cutout angle L13 of the cutout portion 323 is determined as required, for example, the cutout angle L13=60°.

No cutout portion is provided in a portion 326 corresponding to the side water discharge area E2 in the circumferential edge of the deflector 320.

Figure 18:
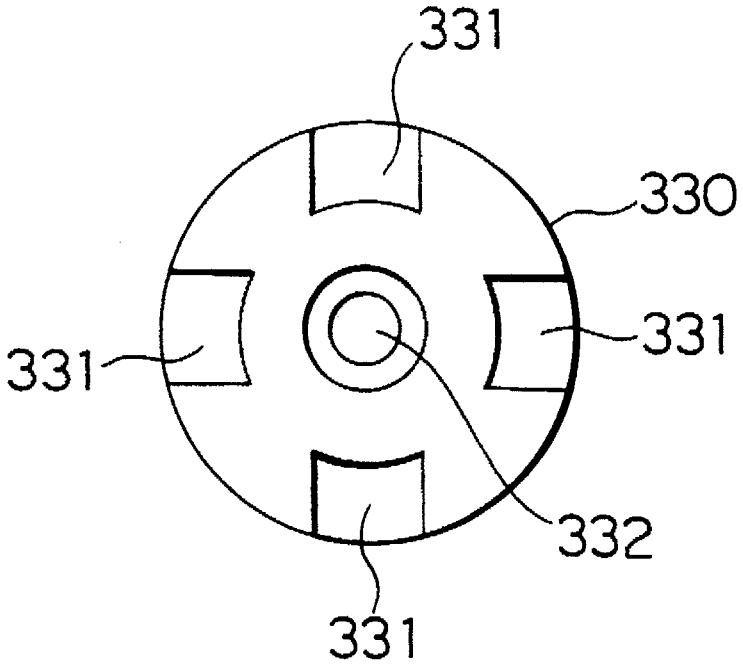
FIG. 18 is a front view of a spiral of the short range nozzle.

A spiral 330 and an orifice 340 are disposed in the inner nozzle 301. As shown in FIG. 18, the spiral 330 is provided with grooves 331 formed spirally on the side wall of the spiral 330, and stirs water for fire-fighting to produce a spiral flow. Reference numeral 332 denotes a water supply hole.

Figure 19:
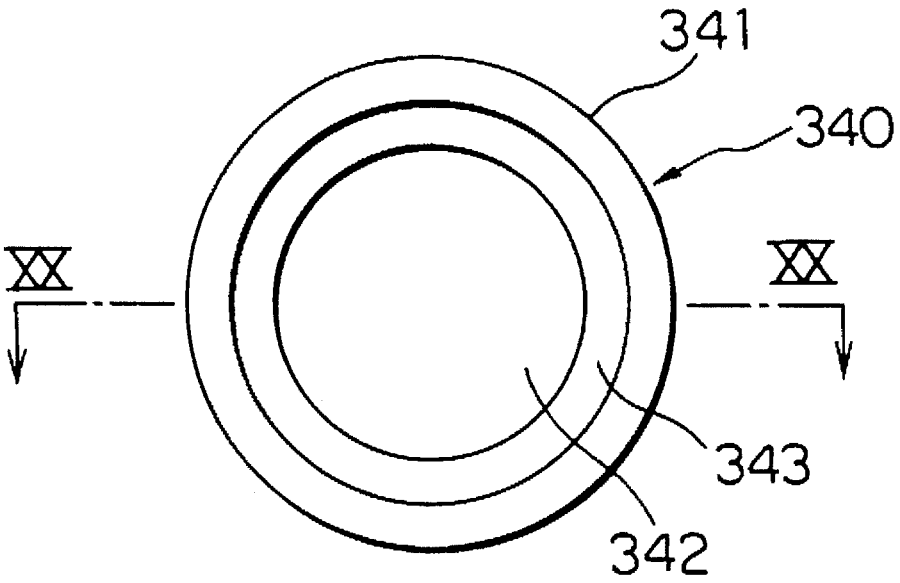
FIG. 19 is a front view of an orifice of the short range nozzle.
Figure 20:
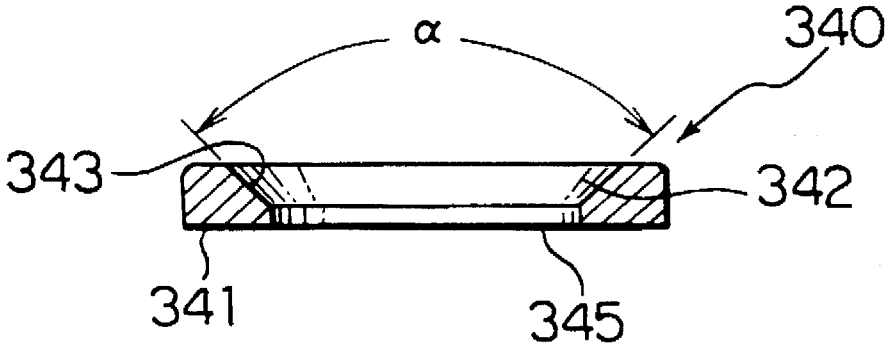
FIG. 20 is a sectional view taken along the line XX—XX of FIG. 19.

As shown in FIGS. 19 and 20, the orifice 340 is formed as a ring 341, and a side inner surface 343 of an exit 342 thereof is formed in a truncated cone shape of a circular cone angle $\alpha$. The circular cone angle $\alpha$ is appropriately determined as required, for example, the circular cone angle $\alpha$=90°. The orifice 340 decreases the pressure of the discharge water flow and increases the discharge water particle size. Reference numeral 345 denotes an entrance.

Figure 4:
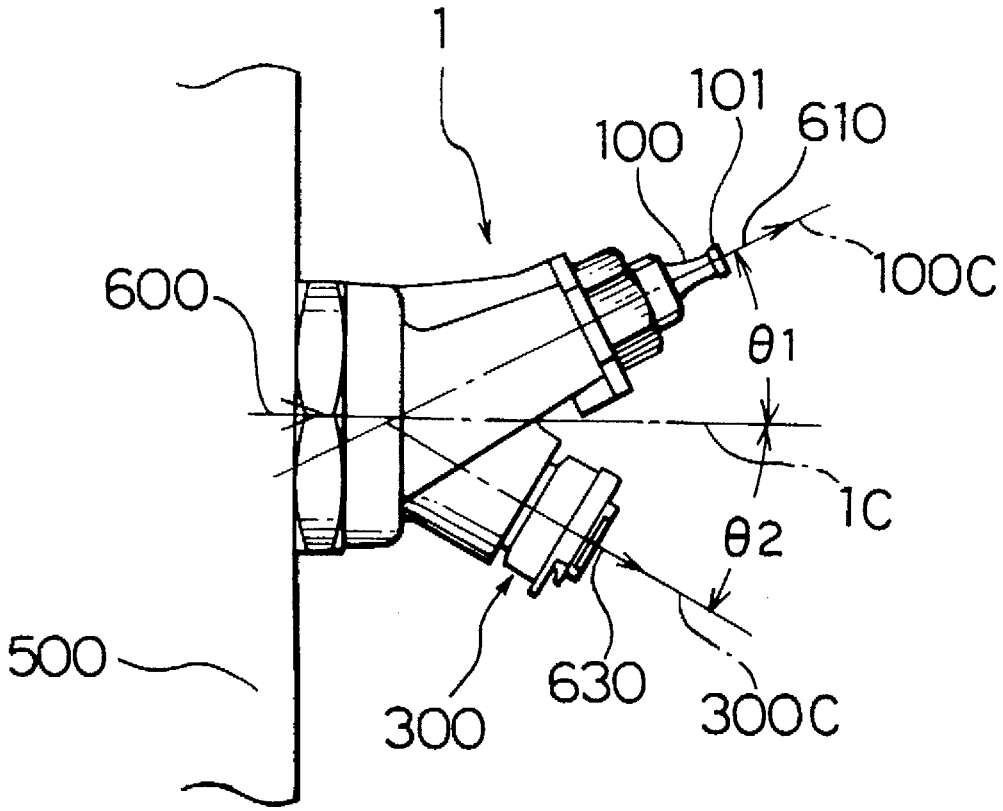
FIG. 4 is a side view illustrating the mounted fire extinguishing head of the first embodiment of the present invention.

Next, the operation of this embodiment will be explained. As shown in FIG. 4, the fire extinguishing head 1 is mounted on a side wall 500 of large space, such as an international exhibition hall. At this time, the center axis 1C of the fire extinguishing head 1 is horizontal. The medium range nozzles 100 and the long range nozzle 200 are directed upward, for example, by an inclination angle $\theta$ 1=26° relative to the center axis 1C. The short range nozzle 300 is directed downward for example, by an inclination angle $\theta$ 2=30° relative to the center axis 1C.

Figure 22:
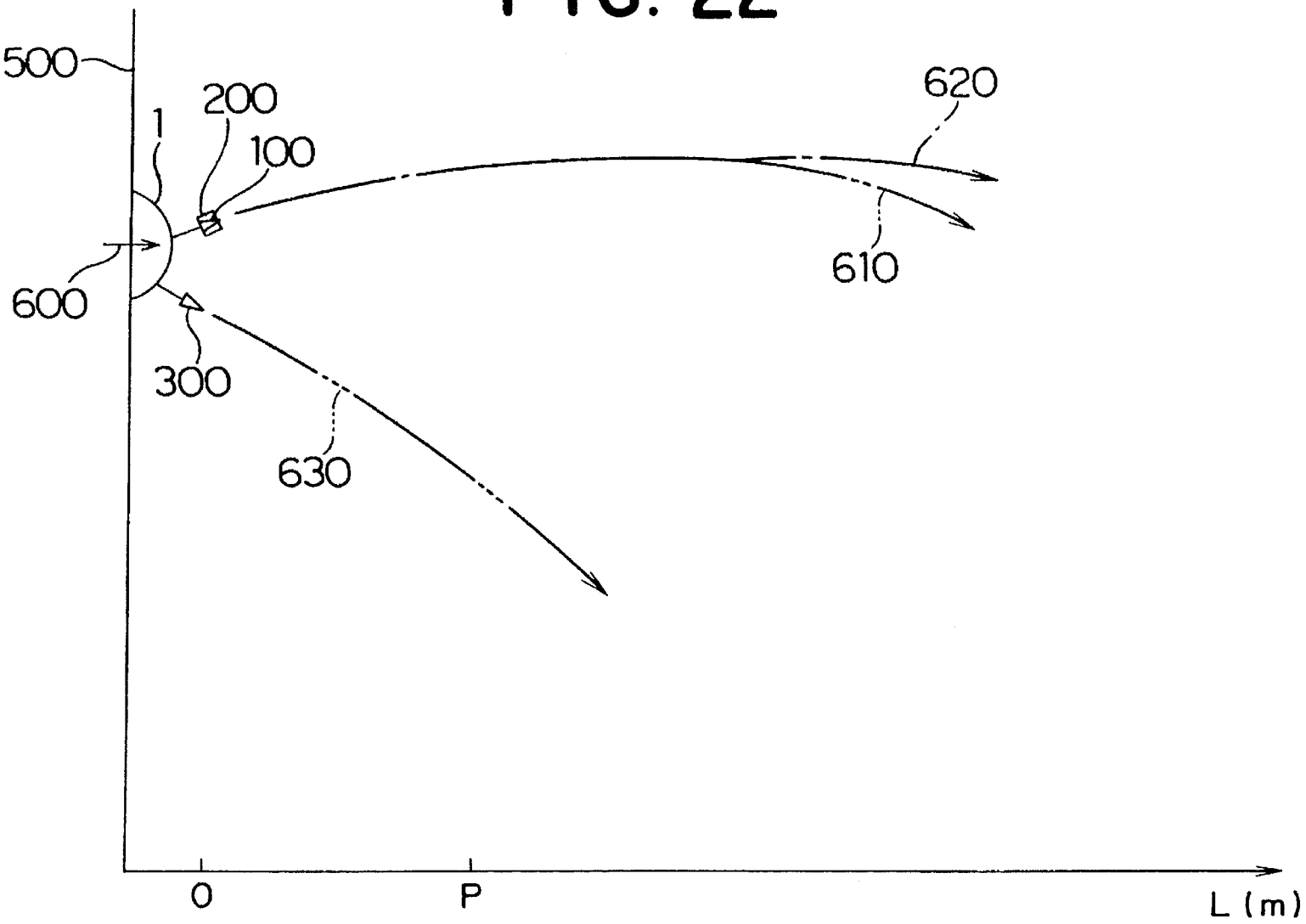
FIG. 22 is a graphical schematic view showing discharge water flow of each nozzle.

When the main valve of fire extinguishing equipment (not shown) is opened and water 600 for fire-fighting is supplied at a predetermined pressure of, for example, 3.5 kgf/cm$^2$ to the fire extinguishing head 1, the water 600 for fire-fighting is discharged from the nozzles 100, 200 and 300 as shown in FIG. 22.

The discharge water flow 610 from each of the medium range nozzles 100 falls describing a parabola and expanding in a fan-shaped form on a plane and collides with a discharge water flow 620 in the form of solid stream from the long range nozzle 200 in the course of its fall. For this reason, the energy of the discharge water flow 620 in the solid stream form is absorbed by the discharge water flow 610, the discharge water flow 610 extends the shooting distance L while riding on the discharge water flow 620, and the discharge water flow 620 is sprinkled on the center line SC of the sprinkling area S5 of the medium range nozzles 100. As a result, the sprinkle water area S5 of the discharge water flow 610 is formed into the shape shown in FIG. 23.

Figure 23:
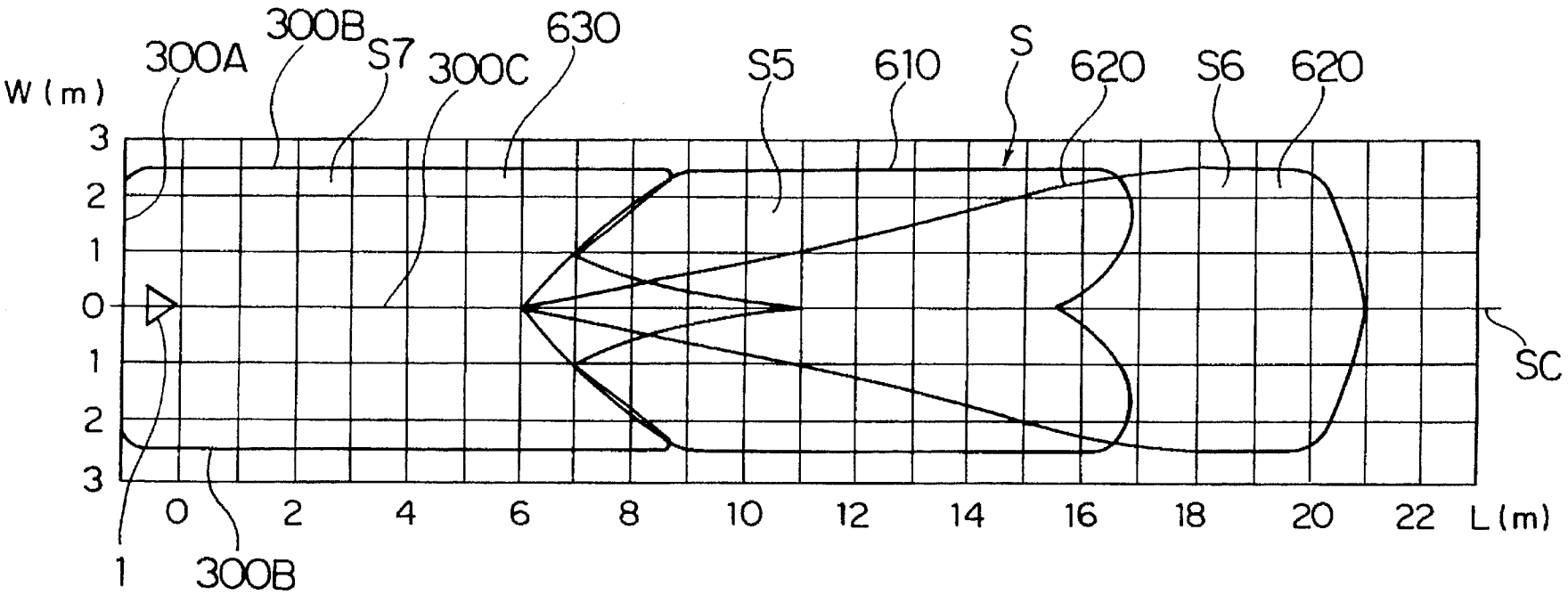
FIG. 23 is a graph showing the rectangular sprinkling area formed by the discharge water flow of each nozzle.

The shooting distance L of the discharge water flow 620 in a solid stream form with its energy absorbed by the discharge water flow 610 decreases less than a case in which the long range nozzle 200 is used by itself, and a sprinkling area S6 shown in FIG. 23 is formed, but the shooting distance L thereof reaches as much as 20 m or more.

As described above, the collision between the discharge water flows 610 and the discharge water flow 620 causes the shooting distance L of the discharge water flow 620 to decrease. However, since the discharge water flows 610 and 620 play the role of a deflector for each other, it is possible to evenly and widely sprinkle water.

In the long range nozzle 200, the large-diameter holes 203, the small-diameter holes 204 and the medium-diameter hole 202 each with a different diameter are disposed spaced horizontally. Therefore, it is possible to sprinkle water over a fixed extension, and also the discharge water flow discharged from each hole is not converged in the center.

Since the large-diameter holes 203 having the largest diameter are disposed on both side ends, the discharge water flows from the large-diameter holes 203 with the longest shooting distance L interfere with discharge water flows having shorter shooting distances discharged from the other holes 202 and 204, and those discharge water flows extend their shooting distance L more than if they are discharged alone. As a result, water sprinkling over a fixed extension can be performed more reliably.

Since the medium-diameter hole 202 is disposed in the center, the large-diameter holes 203 are disposed on both sides of the medium-diameter hole 202, and the small-diameter holes 204 are disposed between the medium-diameter hole 202 and the large-diameter holes 203, discharge water flow from the medium-diameter hole 202 receives less interference of the discharge water flows from the large-diameter holes 203 and the small-diameter holes 204. If the sprinkling area is formed only by the discharge water flows from the large-diameter holes 203 and the medium-diameter hole 202, the sprinkling distribution becomes less uniform, but this inconvenience can be eliminated by the discharge water flows from the small-diameter holes 204.

A discharge water flow 630 discharged from each of the water discharge areas E1, E2 and E3 of the short range nozzle 300 falls describing a parabola and is sprinkled over a discharge area S7 in the vicinity of the fire extinguishing head 1. The short range nozzle 300 is provided with the orifice 340, and the pressure of water 600 for fire-fighting, which is supplied to the fire extinguishing head I and also separately supplied to the short range nozzle 300, is reduced by the orifice 340 to a predetermined pressure, for example, 2.5 kgf/cm$^2$, and therefore the flow rate becomes low.

For this reason, the discharge water flow 630 from the short range nozzle 300 does not affect the discharge water flows 610 from the medium range nozzles 100 and the discharge water flow 620 from the long range nozzle 200, and also the sprinkling particle size increases, thus attaining a high fire extinguishing effect.

After the water 600 for fire-fighting passed through the orifice 340 is formed into a swirl flow by the spiral 330 and then restricted by the reducing section 305, the water 600 is discharged in a circular cone form as the discharge water flow 630 from the inner nozzle 301.

A part of the water 600 for fire-fighting passed through the orifice 340 passes through the water supply holes 303 and the passage 350 and is discharged as the discharge water flow 630 from the cutout portion 314, at the intervals L6 and L7, while being restricted by the deflector 320, the projection pieces 316 to 318 and the guide ring 312, and is sprinkled all over the upper water discharge area E1, the side water discharge areas E2 and the lower water discharge area E3 from the outer nozzle 310.

The upper water discharge area E1 covers mainly water sprinkling for the central portion 300C of the discharge area S7, the side water discharge areas E2 cover mainly water sprinkling for the side portion 300B of the discharge area S7, and the lower water discharge area E3 covers mainly water sprinkling for the back end portion 300A of the discharge area S7.

In this manner, the discharge water flows 610, 620 and 630 from the nozzles 100, 200 and 300 form a large rectangular sprinkling area S as a whole, and also its length L exceeds 20 m and its width W exceeds 5 m. Therefore, the fire extinguishing head 1 makes it possible to efficiently extinguish fire at a building having a large space, such as an atrium.

Since the first embodiment is constructed as described above, the remarkable advantages described below can be obtained.

1) Since the medium range nozzles are disposed in parallel on both sides of the long range nozzle, the discharge water flows from the medium range nozzles collide with the discharge water flow from the long range nozzle in the middle of travel thereof to absorb energy of the discharge water flow from the long range nozzle. For this reason, the discharge water flows from the medium range nozzles extend their shooting distances while riding on the discharge water flow from the long range nozzle. Also, since both the discharge water flows play the role of a deflector for each other because of the collision, it is possible to evenly and widely sprinkle water.
2) Since the short range nozzle is disposed below the long range nozzle and the discharge water flow from the short range nozzle is sprinkled on the area in the vicinity of the short range nozzle, uniform water sprinkling can be performed at a large rectangular fire extinguishing area as a whole, and it is possible to efficiently extinguish fire within a large space.
3) Since the medium range nozzles are formed of a pair of fan-shaped nozzles, it is possible to widen the sprinkling area.
4) Since the long range nozzle is a jet nozzle, the discharge water flow is formed into a solid stream, which is not readily influenced by wind of the discharge water flow of the short range nozzle. For this reason, the shooting distance of the long range nozzle is less influenced by the short range nozzle.
5) Since the short range nozzle is provided with an orifice, it is possible to reduce the water pressure of the water for fire-fighting to increase the sprinkling particle size. For this reason, it is possible to perform sprinkling of water with a high degree of efficiency.

Figure 24:
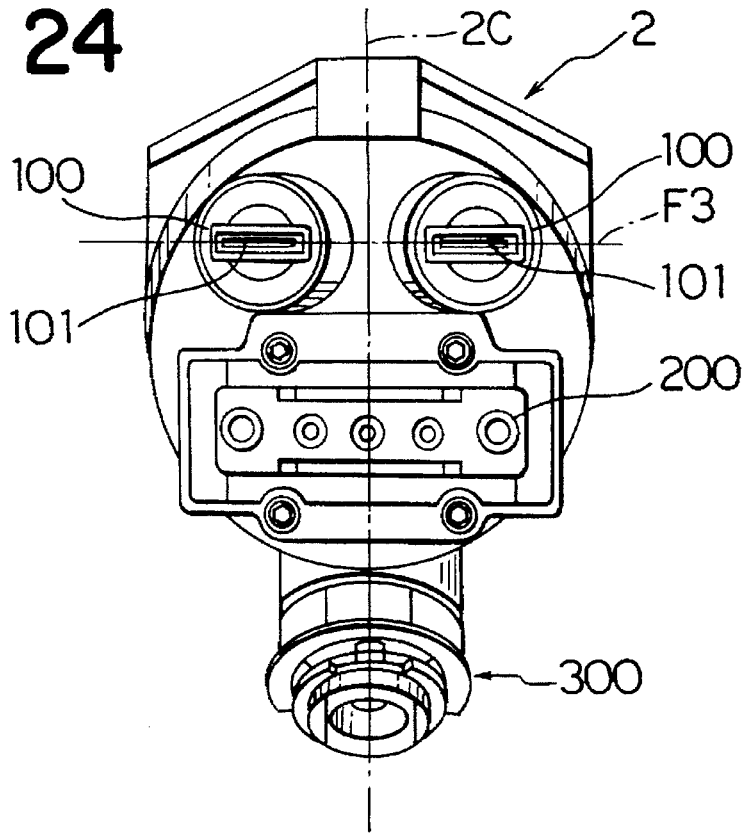
FIGS. 24 to 26 are a front view, a side view and a plan view illustrating a fire extinguishing head in accordance with a second embodiment of the present invention, respectively.
Figure 25:
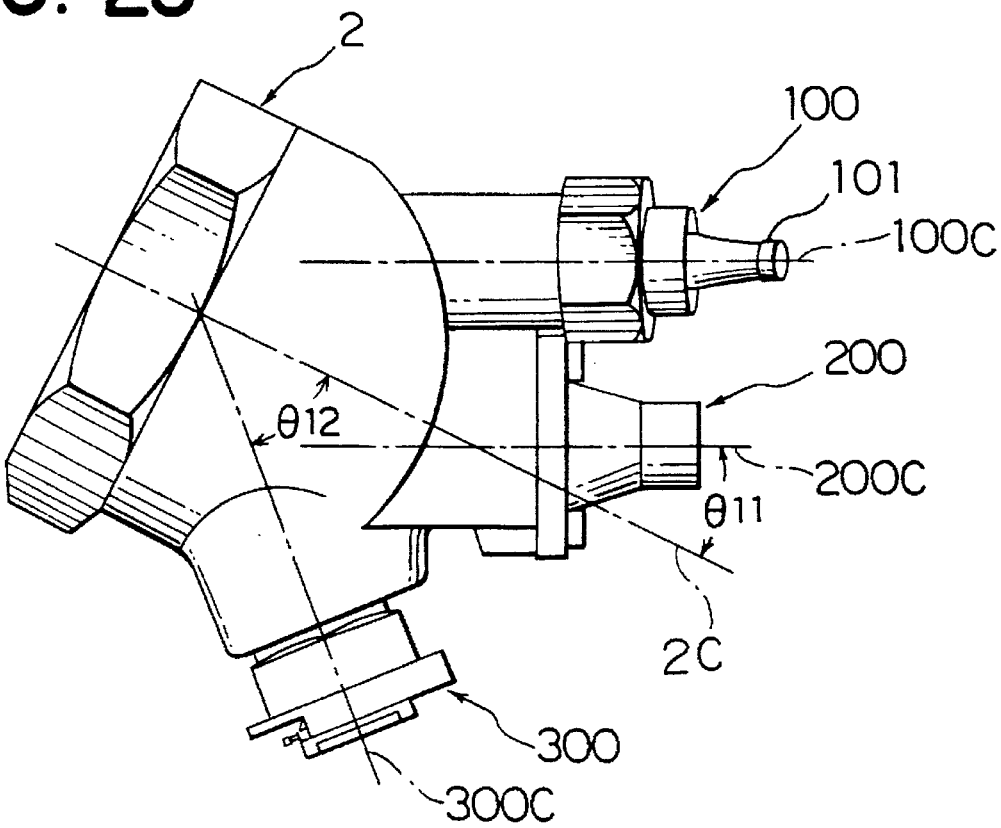
Figure 26:
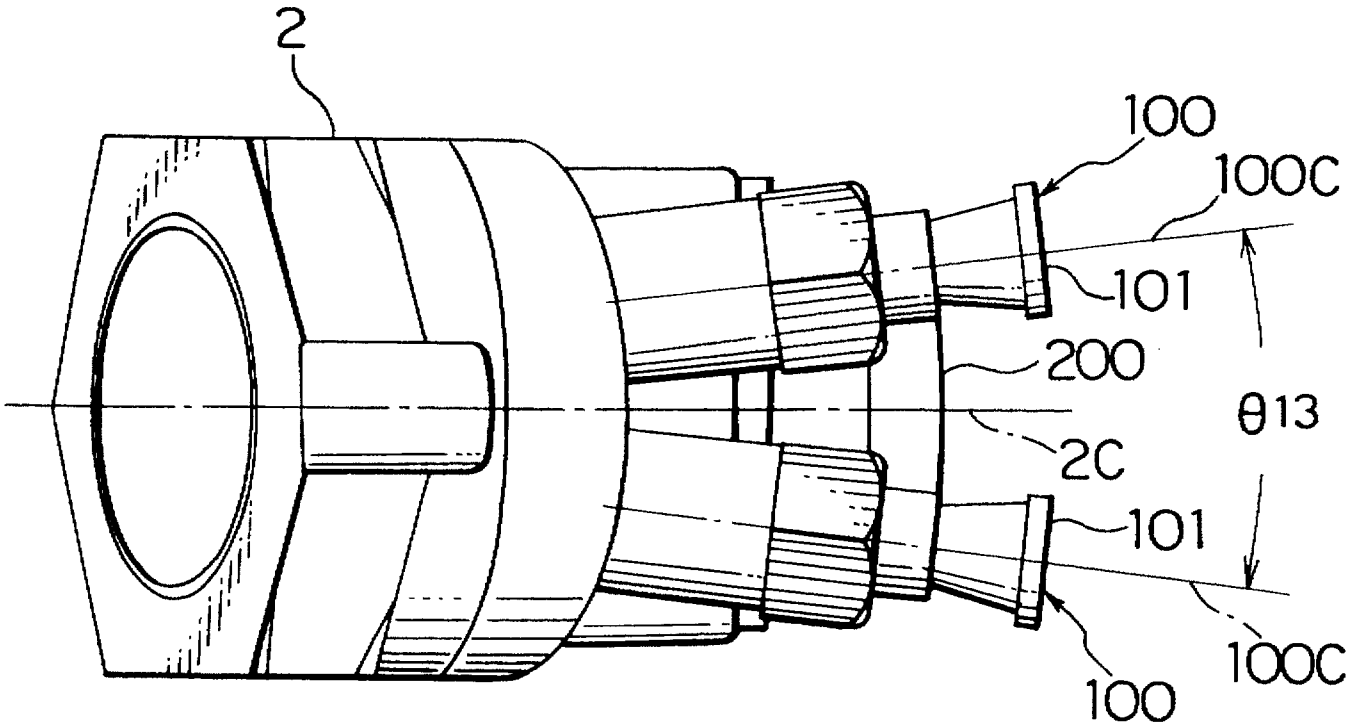

Second Embodiment:

FIGS. 24 to 26 show a fire extinguishing head 2 of a second embodiment of the present invention. The fire extinguishing head 2 is different from the fire extinguishing head 1 in that the respective arrangements of the pair of the medium range nozzles 100, the long range nozzle 200 and the short range nozzle 300 are changed. That is, in the fire extinguishing head 2, the pair of medium range nozzles 100 are disposed on the same horizontal line F3 in such a manner as to sandwich a center axis 2C of the head 2, the long range nozzle 200 is disposed below these medium range nozzles 100, and the short range nozzle 300 is disposed below the long range nozzle 200. The construction of each of the nozzles 100, 200 and 300 is the same as that described in detail in the first embodiment.

The center axis 100C of the medium range nozzles 100 is in parallel to the center axis 200C of the long range nozzle 200, and the center axis 200C is inclined by an angle θ 11 relative to the center axis 2C of the fire extinguishing head 2. The angle θ 11 is appropriately determined by taking the sprinkling area into consideration, for example, the angle θ 11=26° is selected.

The center axis 300C of the short range nozzle 300 is inclined by an angle θ 12 relative to the center axis 2C of the fire extinguishing head 2. The angle θ 12 is appropriately determined by taking the sprinkling area into consideration, for example, the angle θ 12=43° is selected.

Figure 27:
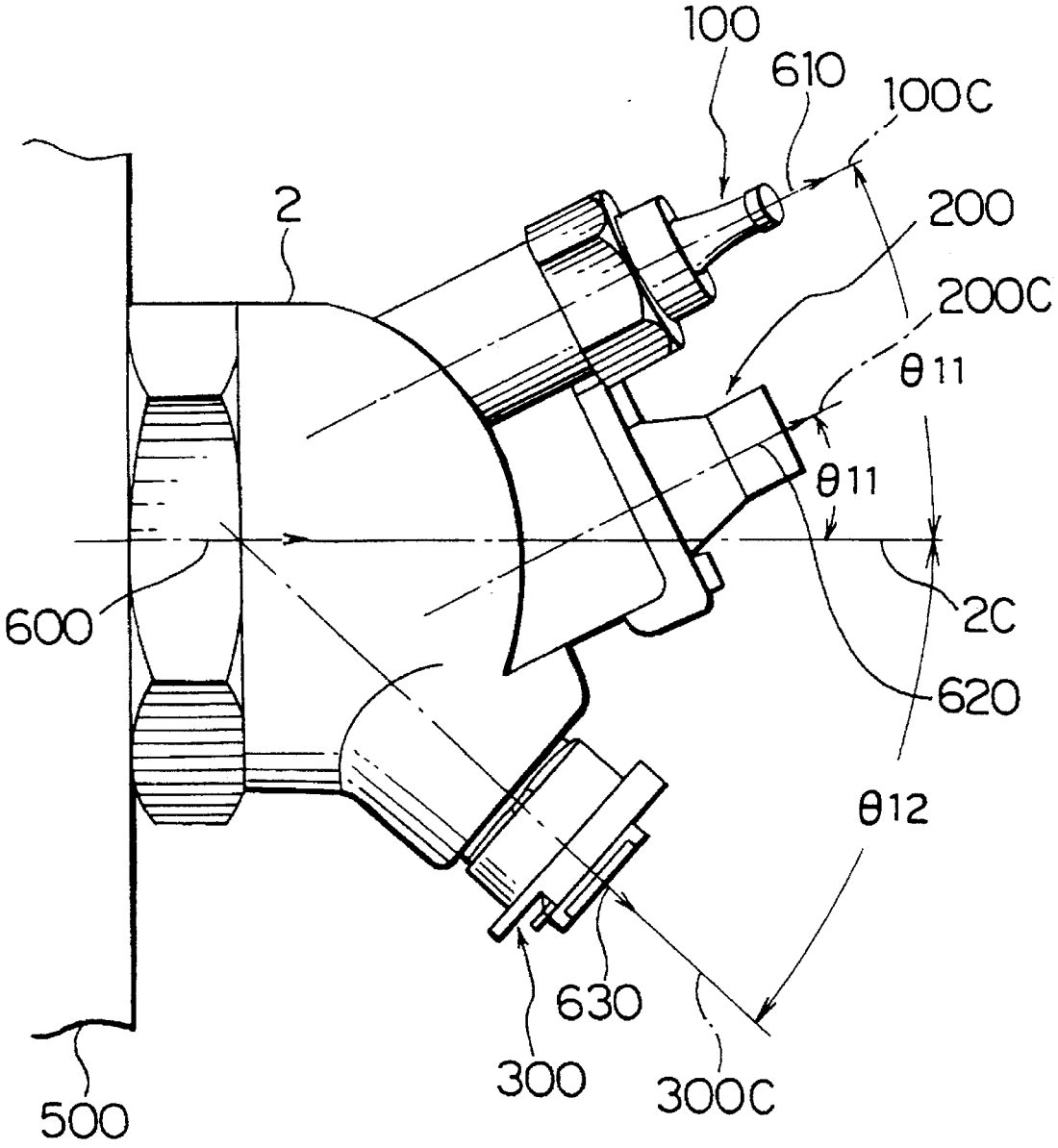
FIG. 27 is a side view illustrating the mounted fire extinguishing head in accordance with the second embodiment of the present invention.

Next, the operation of the second embodiment will be explained. As shown in FIG. 27, the fire extinguishing head 2 is mounted on the side wall 500 of large space, such as an international exhibition hall. At this time, the center axis 2C of the fire extinguishing head 2 is horizontal. The medium range nozzles 100 and the long range nozzle 200 are directed upward, for example, by the inclination angle θ 11=26° relative to the center axis 2C. The short range nozzle 300 is directed downward for example, by the inclination angle θ 12=43° relative to the center axis 2C.

Figure 28:
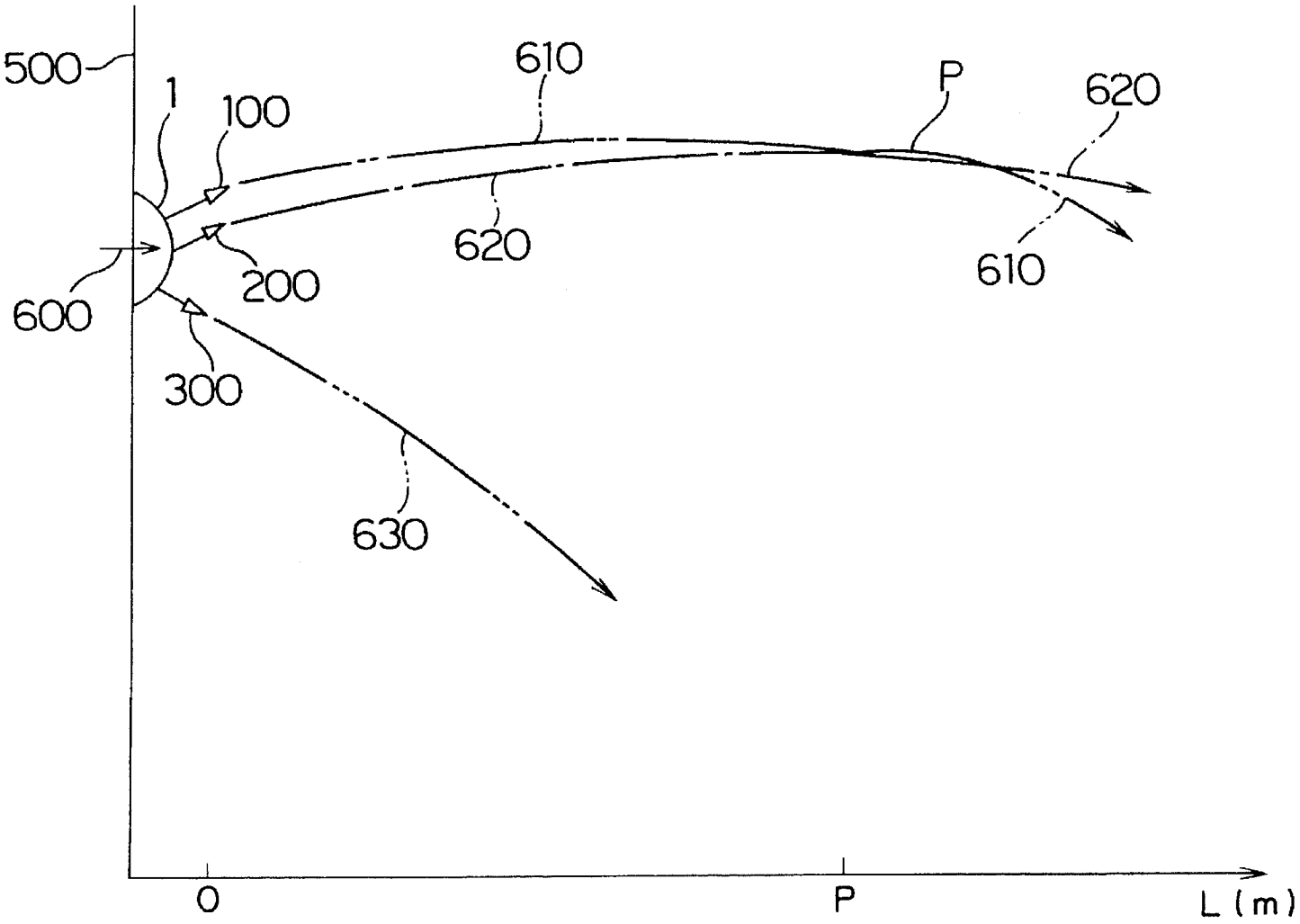
FIG. 28 is a graphical schematic view showing discharge water flow of each nozzle of the fire extinguishing head in accordance with the second embodiment of the present invention.

When the main valve of fire extinguishing equipment (not shown) is opened and water 600 for fire-fighting is supplied at a predetermined pressure of, for example, 3.5 kgf/cm$^2$ to the fire extinguishing head 2, the water 600 for fire-fighting is discharged from the nozzles 100, 200 and 300 as shown in FIG. 28.

In the second embodiment also, the discharge water flow 610 from each of the medium range nozzles 100 falls describing a parabola and expanding in a fan-shaped form in the same manner as in the operation of the first embodiment and collides with a discharge water flow 620 in a solid stream form from the long range nozzle 200 at a spot P. For this reason, the energy of the discharge water flow 620 in a solid stream form is deprived by the discharge water flow 610, while the discharge water flow 610 extends the shooting distance L while riding on the discharge water flow 620.

As described above, in the same way as in the first embodiment, the discharge water flows 610, 620 and 630 from the nozzles 100, 200 and 300 form a large rectangular sprinkling area S shown in FIG. 23 as a whole, and also its length L exceeds 20 m and its width W exceeds 5 m. Therefore, the fire extinguishing head 2 makes it possible to efficiently extinguish fire at a building having a large space, such as an atrium.

Since the second embodiment is constructed as described above, the remarkable advantages described below can be obtained.

1) Since the long range nozzle is disposed below the medium range nozzles, the discharge water flows from the medium range nozzles collide with the discharge water flow from the long range nozzle in the middle of travel thereof and extend their shooting distances while riding on the discharge water flow from the long range nozzle. Also, since both the discharge water flows play the role of a deflector for each other because of the collision, it is possible to evenly and widely sprinkle water.
2) Since the short range nozzle is disposed below the long range nozzle and the discharge water flow from the short range nozzle is sprinkled on the area in the vicinity of the short range nozzle, uniform water sprinkling can be performed at a large rectangular fire extinguishing area as a whole, and it is possible to efficiently extinguish fire within a large space.
3) Since the medium range nozzles are formed of a pair of fan-shaped nozzles, it is possible to widen the sprinkling area.

4) Since the long range nozzle is a jet nozzle, the discharge water flow is formed into a solid stream, which is not readily influenced by wind of the discharge water flow of the short range nozzle. For this reason, the shooting distance of the long range nozzle is not influenced by the short range nozzle.

5) Since the short range nozzle is provided with an orifice, it is possible to reduce the water pressure of the water for fire-fighting to increase the sprinkling particle size. For this reason, it is possible to perform sprinkling of water with a high degree of efficiency.

What is claimed is:

1. A fire extinguishing head comprising:

a first nozzle means;

a second nozzle means having a shooting distance shorter than that of said first nozzle means, a discharge water flow from said first nozzle means colliding with at least a part of a discharge water flow from said second nozzle means in the middle of the fall thereof; and a third nozzle means disposed below said first nozzle means and having a shooting distance shorter than that of said second nozzle means, said third nozzle means comprising an outer nozzle having a water discharge outlet, an inner nozzle engaged with said outer nozzle and having a plurality of water supply holes connected to said water discharge outlet of said outer nozzle, and a deflector which is disposed between said outer nozzle and said inner nozzle.

2. A fire extinguishing head according to claim 1, wherein said outer nozzle comprises a guide ring disposed on the upper surface thereof and a resistance ring disposed concentrically within said guide ring.

3. A fire extinguishing head according to claim 2, wherein said guide ring is provided with a cutout portion for sprinkling water therethrough to form a lower water discharge area.

4. A fire extinguishing head according to claim 3, wherein said resistance ring is provided with a first cutout portion for sprinkling water therethrough to form a lower water discharge area, a plurality of second cutout portions each of which is smaller than said first cutout portion for sprinkling water therethrough to form an upper water discharge area, and a plurality of third cutout portions each of which is smaller than said second cutout portion for sprinkling water therethrough to form a side water discharge area.

5. A fire extinguishing head according to claim 1, wherein said inner nozzle comprises a spiral for forming a swirl flow of water for fire-fighting.

6. A fire extinguishing head according to claim 1, wherein said deflector is provided with a plurality of grooves formed over a sprinkling area corresponding to a lower water discharge area and a cutout portion formed over a sprinkling area corresponding to an upper water discharge area.

7. A fire extinguishing head according to claim 1, wherein said third nozzle means includes an orifice disposed at a portion of a back end side of said inner nozzle.

8. A fire extinguishing head comprising:

a first nozzle means for discharging water over a first distance;

a second nozzle means disposed on both sides of said first nozzle means, for discharging water over a second distance shorter than said first distance of said first nozzle means, a discharge water flow from said first nozzle means colliding with at least a part of a discharge water flow from said second nozzle means in a middle of a fall thereof; and a third nozzle means disposed below said first nozzle means, for discharging water over a third distance shorter than said second distance of said second nozzle means.

9. A fire extinguishing head according to claim 8, wherein said second nozzle means comprises a pair of medium-range nozzles disposed horizontally side by side.

10. A fire extinguishing head according to claim 9, wherein said pair of medium range nozzles are disposed in such a manner that respective center axes thereof diverge outwardly.

11. A fire extinguishing head according to claim 9, wherein each of said medium range nozzles is a fan-shaped nozzle.

12. A fire extinguishing head according to claim 8, wherein said first nozzle means comprises a jet nozzle.

13. A fire extinguishing head according to claim 8, wherein an inclination angle of a center axis of said first nozzle means relative to a center axis of said fire extinguishing head is smaller than an inclination angle of a center axis of said third nozzle means relative to said center axis of said fire extinguishing head.

14. A fire extinguishing head according to claim 8, wherein a center axis of said first nozzle means is parallel to a center axis of said second nozzle means.

15. A fire extinguishing head comprising:

a first nozzle means for discharging water over a first distance;

a second nozzle means disposed above said first nozzle means, for discharging water over a second distance shorter than said first distance of said first nozzle means, a discharge water flow from said first nozzle means colliding with at least a part of a discharge water flow from said second nozzle means in a middle of a fall thereof; and a third nozzle means disposed below said first nozzle means, for discharging water over a third distance shorter than said second distance of said second nozzle means.

16. A fire extinguishing head according to claim 15, wherein said second nozzle means comprises a pair of medium range nozzles disposed horizontally side by side.

17. A fire extinguishing head according to claim 16, wherein said pair of medium range nozzles are disposed in such a manner that respective center axes thereof diverge outwardly.

18. A fire extinguishing head according to claim 16, wherein each of said medium range nozzles is a fan-shaped nozzle.

19. A fire extinguishing head according to claim 15, wherein said first nozzle means comprises a jet nozzle.

20. A fire extinguishing head according to claim 15, wherein an inclination angle of a center axis of said first nozzle means relative to a center axis of said fire extinguishing head is smaller than an inclination angle of a center axis of said third nozzle means relative to said center axis of said fire extinguishing head.

21. A fire extinguishing head according to claim 15, wherein a center axis of said first nozzle means is parallel to a center axis of said second nozzle means.

* * * * *